US005829143A

United States Patent [19]

Gilliam

[11] Patent Number: 5,829,143

[45] Date of Patent: Nov. 3, 1998

[54] LINT REMOVING AND STORING DEVICE

[76] Inventor: Gloria J. Gilliam, 2416 W. Lanvale, Baltimore, Md. 21216

[21] Appl. No.: 915,752

[22] Filed: Aug. 21, 1997

[51] Int. Cl.[6] ..... B26B 3/00

[52] U.S. Cl. ..... 30/136.5; 30/136; 30/172

[58] Field of Search ..... 30/125, 136, 136.5, 30/169, 172, 41.6; 15/236.06, 236.01, 104.001, 104.002

[56] References Cited

U.S. PATENT DOCUMENTS

| | | | |
|---|---|---|---|
| 1,263,526 | 4/1918 | Calita | 30/136 |
| 1,535,632 | 4/1925 | Sperlich | 30/136.5 |
| 2,219,436 | 10/1940 | Anderson | 30/172 |
| 2,507,402 | 5/1950 | DuPont | 03/136.5 X |
| 2,614,431 | 10/1952 | Ackerman | 30/41.6 X |
| 5,077,856 | 1/1992 | Freundl | 15/236.06 X |
| 5,497,525 | 3/1996 | Woodgate | 30/172 X |

*Primary Examiner*—Douglas D. Watts

[57] ABSTRACT

A new LINT REMOVING AND STORING DEVICE for REMOVING BALLS OF LINT FROM CLOTHING AND STORING FOR EASY DISPOSAL. The inventive device includes a molded handle having an upper end having a hollow angled head extending outwardly therefrom. The angled head is defined by an open front face, opposed side walls and open upper and lower ends. A razor blade assembly is positioned within the hollow angled head and is received through the open front face and the open upper end and engaged between the opposed side walls thereof. A lint reservoir housing is provided having a generally L-shaped cross-section. The lint reservoir housing has an upper edge and a lower edge. The upper edge engages lower ends of the opposed side walls of the hollow angled head. The lower edge engages a recess formed within the molded handle disposed below the hollow angled head.

5 Claims, 2 Drawing Sheets

LINT REMOVING AND STORING DEVICE

BACKGROUND OF THE INVENTION

1. Field of the Invention

The present invention relates to LINT REMOVERS and more particularly pertains to a new LINT REMOVING AND STORING DEVICE for REMOVING BALLS OF LINT FROM CLOTHING AND STORING FOR EASY DISPOSAL.

2. Description of the Prior Art

The use of LINT REMOVERS is known in the prior art. More specifically, LINT REMOVERS heretofore devised and utilized are known to consist basically of familiar, expected and obvious structural configurations, notwithstanding the myriad of designs encompassed by the crowded prior art which have been developed for the fulfillment of countless objectives and requirements.

Known prior art LINT REMOVERS include U.S. Pat. No. 5,077,856 to Preundl; U.S. Pat. No. 4,361,923 to McKay; U.S. Pat. No. Des. 306,499 to Lee; U.S. Pat. No. 4,839,964 to Uchiyama et al.; U.S. Pat. No. 4,575,890 to Hidle; and U.S. Pat. No. 4,639,965 to Suzuki.

While these devices fulfill their respective, particular objectives and requirements, the aforementioned patents do not disclose a new LINT REMOVING AND STORING DEVICE. The inventive device includes a molded handle having an upper end having a hollow angled head extending outwardly therefrom. The angled head is defined by an open front face, opposed side walls and open upper and lower ends. A razor blade assembly is positioned within the hollow angled head and is received through the open front face and the open upper end and engaged between the opposed side walls thereof. A lint reservoir housing is provided having a generally L-shaped cross-section. The lint reservoir housing has an upper edge and a lower edge. The upper edge engages lower ends of the opposed side walls of the hollow angled head. The lower edge engages a recess formed within the molded handle disposed below the hollow angled head.

In these respects, the LINT REMOVING AND STORING DEVICE according to the present invention substantially departs from the conventional concepts and designs of the prior art, and in so doing provides an apparatus primarily developed for the purpose of REMOVING BALLS OF LINT FROM CLOTHING AND STORING FOR EASY DISPOSAL.

SUMMARY OF THE INVENTION

In view of the foregoing disadvantages inherent in the known types of LINT REMOVERS now present in the prior art, the present invention provides a new LINT REMOVING AND STORING DEVICE construction wherein the same can be utilized for REMOVING BALLS OF LINT FROM CLOTHING AND STORING FOR EASY DISPOSAL.

The general purpose of the present invention, which will be described subsequently in greater detail, is to provide a new LINT REMOVING AND STORING DEVICE apparatus and method which has many of the advantages of the LINT REMOVERS mentioned heretofore and many novel features that result in a new LINT REMOVING AND STORING DEVICE which is not anticipated, rendered obvious, suggested, or even implied by any of the prior art LINT REMOVERS, either alone or in any combination thereof.

To attain this, the present invention generally comprises a molded handle having a generally rectangular configuration.

The molded handle has gripping ridges formed on front and rear surfaces thereof. An upper end of the molded handle has a hollow angled head extending outwardly therefrom. The angled head is defined by an open front face, opposed side walls and open upper and lower ends. The opposed side walls each have a detent formed therein. A razor blade assembly is provided including a generally U-shaped housing. The U-shaped housing has a top horizontal wall, a pair of downwardly extending side walls and an open lower end. The top horizontal wall has a grasping handle extending upwardly therefrom. Each of the side walls has a projection extending outwardly therefrom. The razor blade assembly includes a plurality of blades positioned between the pair of downwardly extending side walls in an angular orientation with a space disposed between each individual blade. The razor blade assembly is positioned within the hollow angled head and is received through the open front face and the open upper end and engaged between the opposed side walls thereof. The projections engage the detents in the opposed side walls. A lint reservoir housing is provided having a generally L-shaped cross-section. The lint reservoir housing has an upper edge and a lower edge. The upper edge engages lower ends of the opposed side walls of the hollow angled head. The lower edge engages a recess formed within the molded handle disposed below the hollow angled head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new LINT REMOVING AND STORING DEVICE apparatus and method which has many of the advantages of the LINT REMOVERS mentioned heretofore and many novel features that result in a new LINT REMOVING AND STORING DEVICE which is not anticipated, rendered obvious, suggested, or even implied by any of the prior art LINT REMOVERS, either alone or in any combination thereof.

It is another object of the present invention to provide a new LINT REMOVING AND STORING DEVICE which may be easily and efficiently manufactured and marketed.

It is a further object of the present invention to provide a new LINT REMOVING AND STORING DEVICE which is of a durable and reliable construction.

An even further object of the present invention is to provide a new LINT REMOVING AND STORING DEVICE which is susceptible of a low cost of manufacture with regard to both materials and labor, and which accordingly is then susceptible of low prices of sale to the consuming public, thereby making such LINT REMOVING AND STORING DEVICE economically available to the buying public.

Still yet another object of the present invention is to provide a new LINT REMOVING AND STORING DEVICE which provides in the apparatuses and methods of the prior art some of the advantages thereof, while simultaneously overcoming some of the disadvantages normally associated therewith.

Still another object of the present invention is to provide a new LINT REMOVING AND STORING DEVICE for REMOVING BALLS OF LINT FROM CLOTHING AND STORING FOR EASY DISPOSAL.

Yet another object of the present invention is to provide a new LINT REMOVING AND STORING DEVICE which includes a molded handle having an upper end having a hollow angled head extending outwardly therefrom. The angled head is defined by an open front face, opposed side walls and open upper and lower ends. A razor blade assembly is positioned within the hollow angled head and is received through the open front face and the open upper end and engaged between the opposed side walls thereof. A lint reservoir housing is provided having a generally L-shaped cross-section. The lint reservoir housing has an upper edge and a lower edge. The upper edge engages lower ends of the opposed side walls of the hollow angled head. The lower edge engages a recess formed within the molded handle disposed below the hollow angled head.

Still yet another object of the present invention is to provide a new LINT REMOVING AND STORING DEVICE that removes unsightly pills of fuzz to provide the item with a fresh, new appearance.

Even still another object of the present invention is to provide a new LINT REMOVING AND STORING DEVICE that resembles a standard razor in appearance and function.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
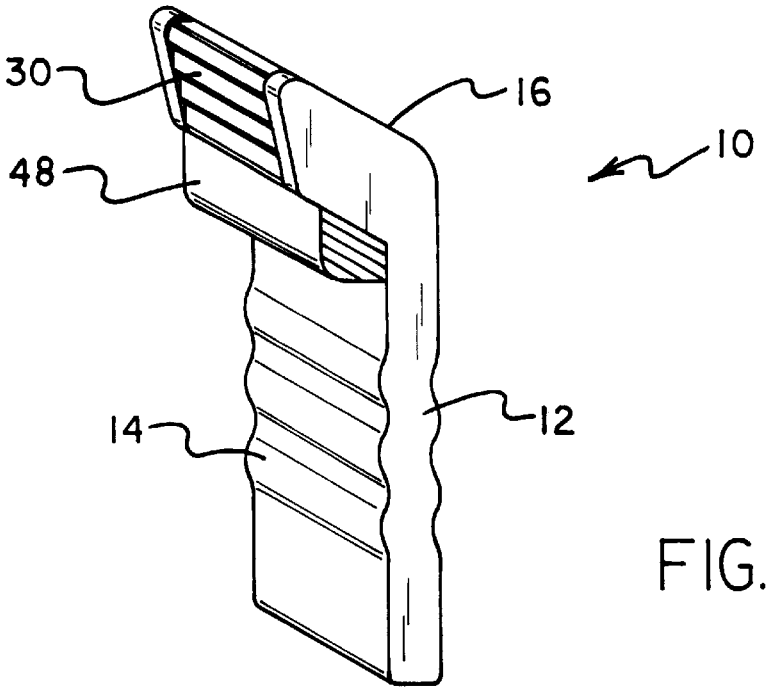
FIG. 1 is a perspective view of a new LINT REMOVING AND STORING DEVICE according to the present invention.
Figure 2:
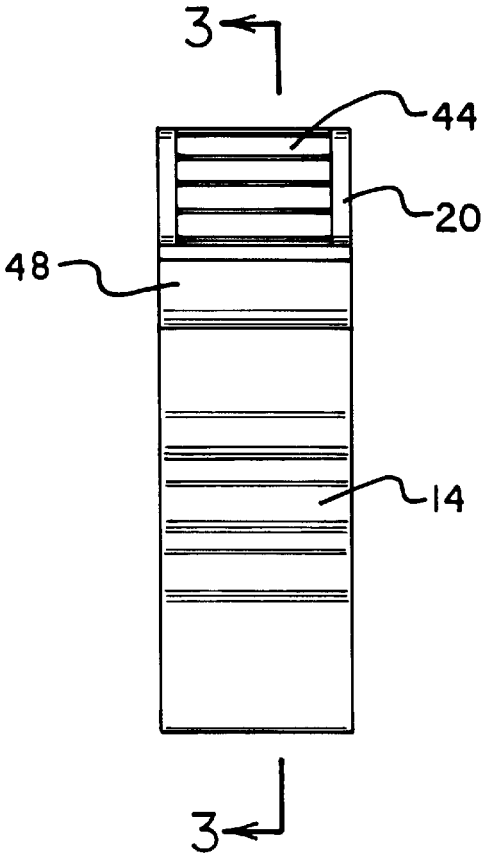
FIG. 2 is a front elevation view of the present invention.
Figure 3:
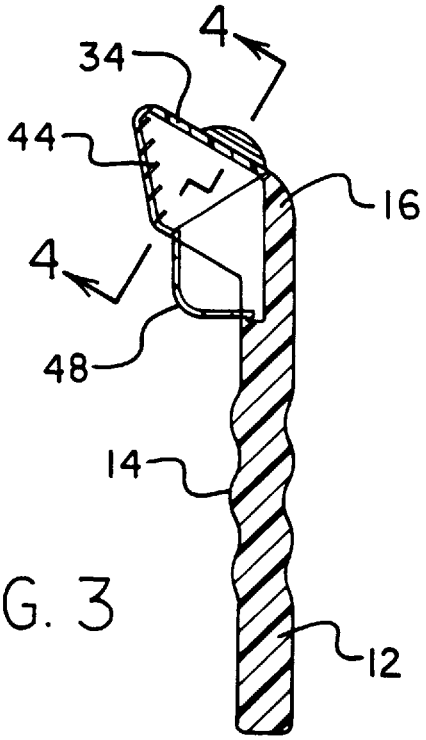
FIG. 3 is a cross-sectional view of the present invention as taken along line 3—3 of FIG. 2.
Figure 4:
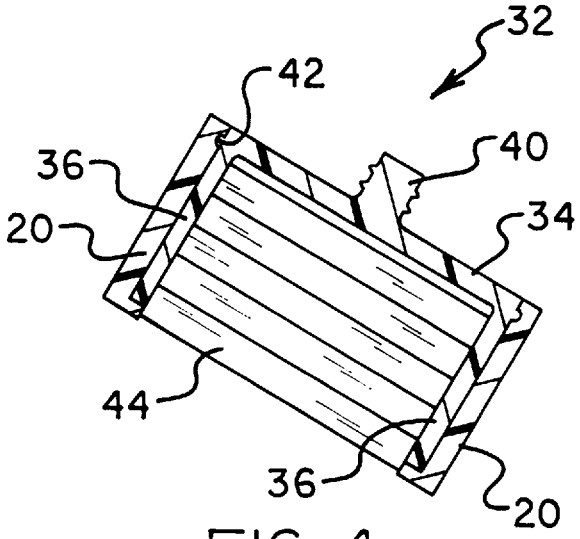
FIG. 4 is a cross-sectional view of the present invention as taken along line 4—4 of FIG. 3.
Figure 5:
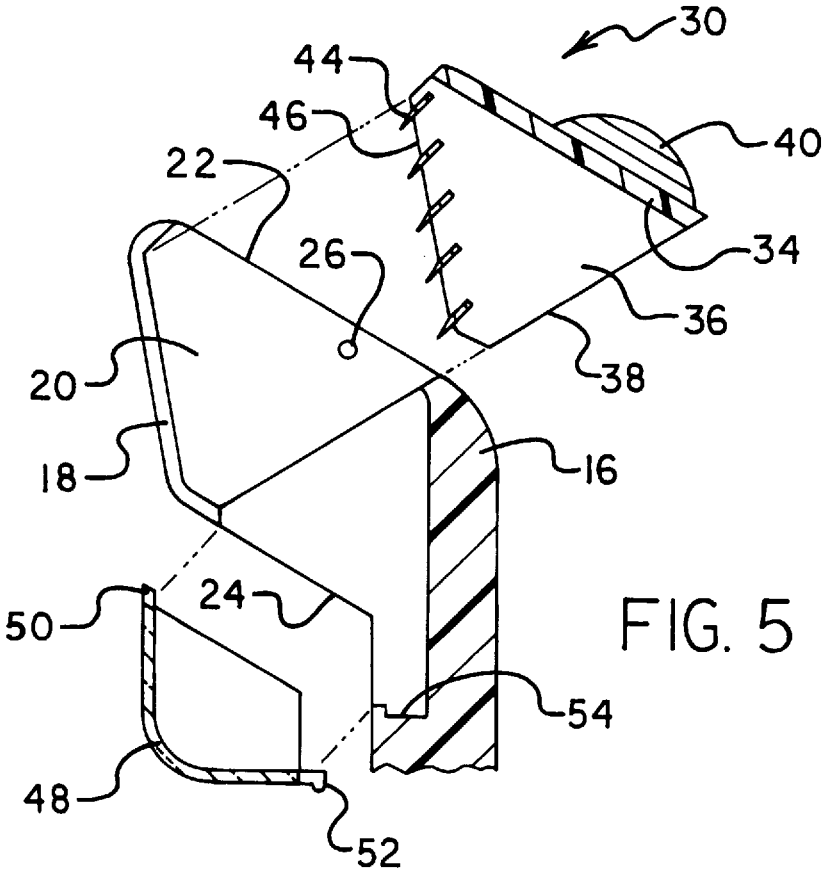
FIG. 5 is a sectional side view of the present invention shown in cross-section.

With reference now to the drawings, and in particular to FIGS. 1 through 5 thereof, a new LINT REMOVING AND STORING DEVICE embodying the principles and concepts of the present invention and generally designated by the reference numeral 10 will be described.

As best illustrated in FIGS. 1 through 5, the LINT REMOVING AND STORING DEVICE 10 comprises a molded handle 12 having a generally rectangular configuration. The molded handle 12 has gripping ridges 14 formed on front and rear surfaces thereof. An upper end of the molded handle 12 has a hollow angled head 16 extending outwardly therefrom. The angled head 16 is defined by an open front face 18, opposed side walls 20 and open upper 22 and lower ends 24. The opposed side walls 20 each have a detent 26 formed therein.

A razor blade assembly 30 is provided including a generally U-shaped housing 32. The U-shaped housing has a top horizontal wall 34, a pair of downwardly extending side walls 36 and an open lower end 38. The top horizontal wall 34 has a grasping handle 40 extending upwardly therefrom. Each of the side walls 36 has a projection 42 extending outwardly therefrom. The razor blade assembly 30 includes a plurality of blades 44 positioned between the pair of downwardly extending side walls 36 in an angular orientation with a space 46 disposed between each individual blade 44. The razor blade assembly 30 is positioned within the hollow angled head 16 and is received through the open front face 18 and the open upper end 22 and engaged between the opposed side walls 20 thereof. The projections 42 engage the detents 26 in the opposed side walls 20.

A lint reservoir housing 48 is provided having a generally L-shaped cross-section. The lint reservoir housing 48 has an upper edge 50 and a lower edge 52. The upper edge 50 engages lower ends of the opposed side walls 20 of the hollow angled head 16. The lower edge 52 engages a recess 54 formed within the molded handle 12 disposed below the hollow angled head 16.

In use, the present invention can remove unsightly pills of fuzz and lint to provide an item of clothing with a fresh, new appearance. The present invention resembles a standard razor in function and appearance. The lint reservoir housing 48 is positioned beneath the razor blade assembly 30 whereby when the blades 44 are run over the fabric, the lint reservoir housing 48 will store the removed pills of fuzz and lint. Once the housing 48 becomes filled, or after each use, it can be simply removed to be emptied. As the blades 44 slide across the surface of the item, the threads of the lint or fuzz would be cut and stored within the housing 48. The surface of the item of clothing would then appear smooth and essentially, like new.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lint removing and storing device for removing balls of lint from clothing and storing for easy disposal comprising, in combination:

a molded handle having a generally rectangular configuration, the molded handle having gripping ridges formed on front and rear surfaces thereof, an upper end of the molded handle having a hollow angled head extending outwardly therefrom, the angled head being defined by an open front face, opposed side walls and open upper and lower ends, the opposed side walls each having a detent formed therein;

a razor blade assembly including a generally U-shaped housing, the U-shaped housing having a top horizontal wall, a pair of downwardly extending side walls and an open lower end, the top horizontal wall having a grasping handle extending upwardly therefrom, each of the side walls having a projection extending outwardly therefrom, the razor blade assembly including a plurality of blades positioned between the pair of downwardly extending side walls in an angular orientation with a space disposed between each individual blade, the razor blade assembly positioned within the hollow angled head being received through the open front face and the open upper end and engaged between the opposed side walls thereof, the projections engaging the detents in the opposed side walls; and a lint reservoir housing having a generally L-shaped cross-section, the lint reservoir housing having an upper edge and a lower edge, the upper edge engaging lower ends of the opposed side walls of the hollow angled head, the lower edge engaging a recess formed within the molded handle disposed below the hollow angled head.

2. A lint removing and storing device for removing balls of lint from clothing and storing for easy disposal comprising, in combination:

a molded handle having an upper end having a hollow angled head extending outwardly therefrom, the angled head being defined by an open front face, opposed side walls and open upper and lower ends;

a razor blade assembly positioned within the hollow angled head being received through the open front face and the open upper end and engaged between the opposed side walls thereof; and a lint reservoir housing having a generally L-shaped cross-section, the lint reservoir housing having an upper edge and a lower edge, the upper edge engaging lower ends of the opposed side walls of the hollow angled head, the lower edge engaging a recess formed within the molded handle disposed below the hollow angled head.

3. The lint removing and storing device as set forth in claim 2 wherein the molded handle has gripping ridges formed on front and rear surfaces thereof.

4. The lint removing and storing device as set forth in claim 2 wherein the razor blade assembly includes a generally U-shaped housing, the U-shaped housing having a top horizontal wall, a pair of downwardly extending side walls and an open lower end, the top horizontal wall having a grasping handle extending upwardly therefrom, the razor blade assembly including a plurality of blades positioned between the pair of downwardly extending side walls in an angular orientation with a space disposed between each individual blade.

5. The lint removing and storing device as set forth in claim 2 wherein the opposed side walls of the hollow angled head each have a detent formed therein and the razor blade assembly has projections extending outwardly from sides thereof for engaging the detents.

* * * * *